US006006710A

United States Patent [19]

Stephan

[11] Patent Number: 6,006,710

[45] Date of Patent: Dec. 28, 1999

[54] HYDRAULIC LASH ADJUSTER MECHANISM WITH PRESSURE CONTROLLED LEAK DOWN

[75] Inventor: Craig Hammann Stephan, Ann Arbor, Mich.

[73] Assignee: Ford Global Technologies, Inc., Dearborn, Mich.

[21] Appl. No.: 09/144,612

[22] Filed: Aug. 31, 1998

[51] Int. Cl.[6] ..... F01L 1/24

[52] U.S. Cl. ..... 123/90.43; 123/90.36; 123/90.57

[58] Field of Search ..... 123/90.35, 90.36, 123/90.39, 90.41, 90.43, 90.46, 90.55, 90.57

[56] References Cited

U.S. PATENT DOCUMENTS

| | | | |
|---|---|---|---|
| 3,273,548 | 9/1966 | Hoffman . | |
| 3,587,539 | 6/1971 | Dadd . | |
| 3,799,129 | 3/1974 | Cornell . | |
| 3,805,753 | 4/1974 | Bergmann . | |
| 4,004,558 | 1/1977 | Scheibe . | |
| 4,098,240 | 7/1978 | Abell . | |
| 4,438,739 | 3/1984 | Arai . | |
| 4,462,364 | 7/1984 | Kodama . | |
| 4,481,913 | 11/1984 | Wirth . | |
| 4,589,383 | 5/1986 | Showalter . | |
| 4,596,213 | 6/1986 | Hillebrand . | |
| 4,601,268 | 7/1986 | Rhoads | 123/90.55 |
| 4,633,827 | 1/1987 | Buente . | |
| 4,807,576 | 2/1989 | Sonoda . | |
| 4,840,153 | 6/1989 | Aida . | |
| 4,977,867 | 12/1990 | Rhoads | 123/90.49 |
| 5,398,648 | 3/1995 | Spath . | |
| 5,622,147 | 4/1997 | Edelmayer . | |
| 5,623,898 | 4/1997 | Bruton | 123/90.35 |
| 5,660,153 | 8/1997 | Hampton . | |
| 5,758,613 | 6/1998 | Edelmayer et al. | 123/90.35 |
| 5,862,784 | 1/1999 | Blowers | 123/90.36 |
| 5,862,785 | 1/1999 | Blowers et al. | 123/90.43 |
| 5,901,676 | 5/1999 | Edelmayer | 123/90.35 |

*Primary Examiner*—Weilun Lo
*Attorney, Agent, or Firm*—Roger May; Jerome Drovillard

[57] ABSTRACT

A hydraulic lash adjuster mechanism for an internal combustion engine, the adjuster having a body having a bore formed therein with a piston slidingly received within the bore. The lash adjuster is in communication with one end of a cam follower that is in communication at its other end with a valve stem. A rotating cam contacts said cam follower to apply force to the piston during a valve lift event. The lash adjuster has a low pressure chamber formed in the piston and a high pressure chamber formed between the bottom of the bore and the bottom of the piston. Engine fluid that is passed to the low pressure chamber is in communication with the high pressure chamber through a valve opening. A mechanism selectively opens or closes the valve opening in response to pressure differences between the low pressure chamber and the high pressure chamber. An actuating means is included for allowing free leak down of engine fluid from the high pressure chamber to the low pressure chamber when the cam follower is on the cam base circle.

16 Claims, 1 Drawing Sheet

HYDRAULIC LASH ADJUSTER MECHANISM WITH PRESSURE CONTROLLED LEAK DOWN

TECHNICAL FIELD

The present invention relates generally to hydraulic lash adjusters. More specifically, the present invention relates to a hydraulic lash adjuster for an internal combustion engine that more accurately controls the leak down rate of engine fluid within the lash adjuster in response to increased pressure on a corresponding valve stem.

BACKGROUND

Hydraulic lash adjusters are well known for use in internal combustion engines. Hydraulic lash adjuster mechanisms are used to eliminate clearance or lash between engine valve train components which can occur under varying operating conditions. Hydraulic lash adjusters are also used in order to maintain engine efficiency, reduce engine noise, and reduce wear in the valve train.

Hydraulic lash adjusters operate by transmitting the energy of the valve actuating cam through oil trapped in a pressure chamber beneath a plunger. During each operation of the cam, as the length of the valve actuating components varies due to temperature changes for example, small quantities of hydraulic fluid are permitted to enter or escape from the pressure chamber. As the hydraulic fluid enters or escapes the pressure chamber, the position of the plunger is adjusted and consequently the effective total length of the valve train is adjusted which minimizes or eliminates the lash.

Conventional hydraulic lash adjusters have a leak down rate controlled by a leak path defined by precise clearance between two concentric tubes, namely, the plunger and the outer cylinder, such as disclosed in U.S. Pat. No. 5,622,147. The leak down rate must be sufficiently fast so that as the exhaust valve heats and expands, the lash adjuster can relax and accommodate the expansion. If the leak down rate is too slow, the exhaust valve may not seat completely, potentially causing engine problems such as loss of power output and deposit buildup on the valve stem. These problems can be exacerbated with engine strategies that deliberately create high-temperature exhaust to quickly light off the catalyst, with the result that the exhaust valve also quickly heats and expands. While lash adjusters can quickly compensate for component shrinkage, they require more time to compensate for component expansion.

Similarly, a lash adjuster leak clown rate that is too fast can cause the adjuster to relax sufficiently during a single cycle that the cam follower loses contact with the cam. When this occurs, the exhaust valve can slam shut, causing noise which is most evident under hot idle conditions. Furthermore, since the leak down rate varies with oil viscosity, both the grade of oil used and the temperature will affect the leak down rate. Thus, current lash adjusters with fixed leak paths may be unable to provide leak down rates that are satisfactory for all operating conditions. For example, when an engine's oil is cold, and thus highly viscous, the leak down rate is slow. Because the leak path between the plunger and the lash adjuster body remains constant prior adjusters cannot increase the leak down to compensate for this condition.

Moreover, since the leak down rate depends strongly on the magnitude of the gap between the two concentric tubes, slight changes in dimensions will have a large effect on the leak down rate. As a result, these tubes typically are provided with a lapped finish and are matched to provide the required accuracy in leak down rate. Providing lash adjusters with consistent leak paths is an expensive process.

SUMMARY OF THE INVENTION

The present invention is directed to overcoming one or more of the problems as set forth above. It is an object of the present invention to provide a lash adjuster mechanism that eliminates need for a leak path between the lash adjuster piston and the lash adjuster cylinder and thus eliminates the need to precisely control the machining of the lash adjuster piston and the lash adjuster cylinder.

A further object of the present invention is to provide a lash adjuster mechanism that can compensate for increased force on the lash adjuster piston by allowing leak down of hydraulic fluid at a high rate when the cam follower is riding on the base circle of the cam.

According to the present invention, the foregoing and other objects are attained by providing a hydraulic lash adjuster mechanism for an internal combustion engine having a body with a bore formed therein and a piston slidingly received within and contacting the periphery of the bore. The lash adjuster is in communication at one end with a cam follower and in communication with a valve stem at the other end. A cam applies force to the piston during a valve lift event. A low pressure chamber is formed in the piston, and is in fluid communication with a high pressure chamber formed between the bottom of the bore and the bottom surface of the piston. Hydraulic fluid is supplied to the low pressure chamber through an inlet opening and is transferred to the high pressure chamber through a valve opening.

The lash adjuster also includes a moveable mechanism for selectively opening or closing the valve opening in response to pressure differences between the low pressure chamber and the high pressure chamber. A leak down control mechanism is included which is movable between a first position preventing leak down of engine fluid and a second position allowing free leak down of engine fluid from the high pressure chamber to the low pressure chamber when the cam follower is on the cam base circle.

Additionally, the lash adjuster mechanism further includes a leak hole formed through the bottom surface of the piston allowing free leak down of engine fluid from the high pressure chamber during non-valve-lift conditions. The leak down control mechanism preferably comprises a curved washer located beneath the bottom surface of the piston. The washer is movable between a first position sealing off the leak hole and a second position allowing free leak down of engine fluid to the low pressure chamber. When there is a small difference between the pressure in the low and high pressure chambers, the curved washer allows free leak down of hydraulic fluid through the leak hole.

Additional objects and features of the present invention will become apparent upon review of the drawings and accompanying detailed description of the preferred embodiments.

DESCRIPTION OF THE PREFERRED EMBODIMENT

Figure 1:
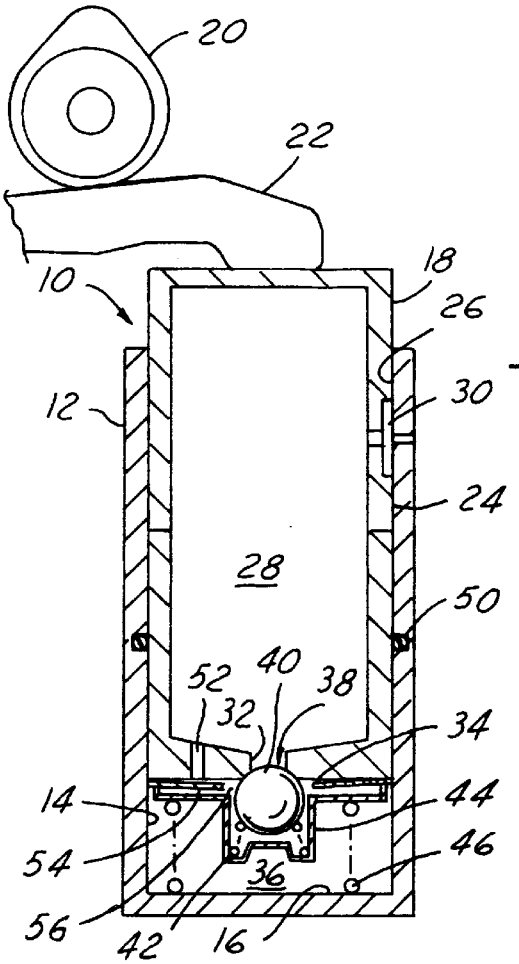
FIG. 1 is a cross-sectional illustration of a schematic lash adjuster mechanism with a leak hole formed in the bottom surface of the piston in accordance with a preferred embodiment of the present invention.
Figure 2:
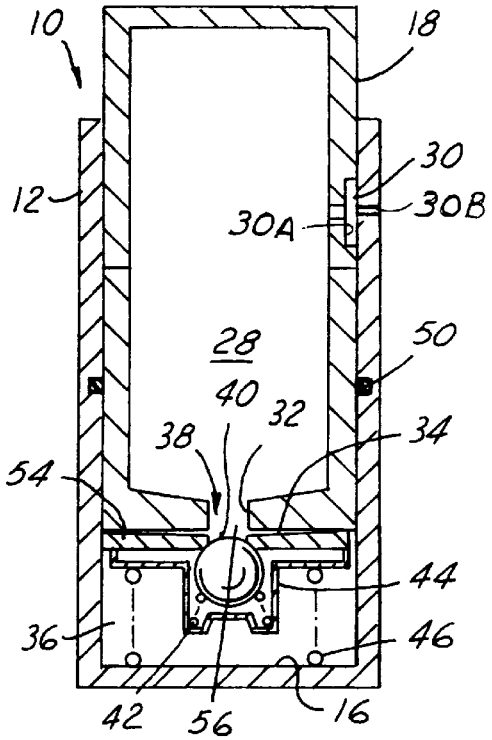
FIG. 2 is a cross-sectional illustration of a schematic lash adjuster mechanism without a leak hole or other separate leak path in accordance with a preferred embodiment of the present invention.
Figure 3:
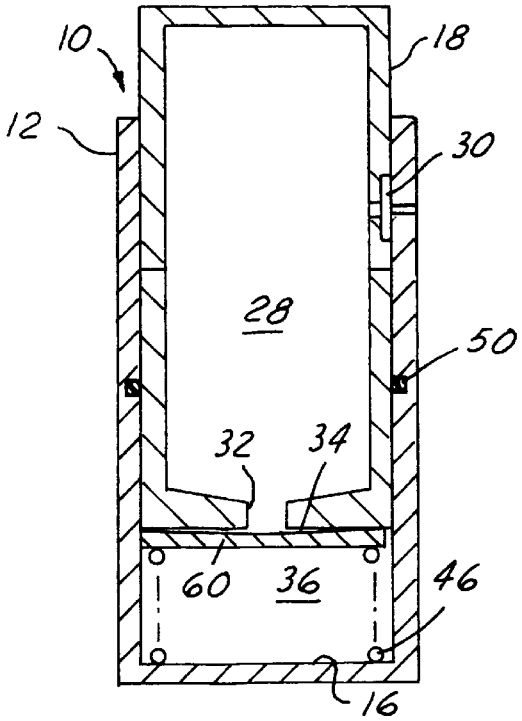
FIG. 3 is cross-sectional illustration of a schematic lash adjuster mechanism with a curved disc regulating the flow of oil from the high pressure chamber in accordance with a preferred embodiment of the present invention.

FIG. 1 illustrates a preferred embodiment of a lash adjuster mechanism in accordance with the present invention. It should be understood that FIGS. 1 through 3 are schematic drawings intended to illustrate the operation of the present invention and not intended to be an exact replication of a commercial lash adjuster. The lash adjuster 10 includes a body member 12 in which a bore 14 is formed. The bottom of the bore 14 is defined by a bottom bore surface 16. A piston 18 is telescopically positioned within the bore 14, such that the piston 18 can move with respect to the body member 12. The piston 18 is preferably in communication with a valve actuated cam 20 through a primary cam follower 22 which allows the piston 18 to move toward and away from the bottom bore surface 16. The piston 18 preferably comprises two pieces or halves for ease of construction.

The outer diameter 24 of the piston 18 and the inner diameter 26 of the body member 12 are in sliding contact. This is unlike current lash adjusters that provide a leak path between the outer diameter of the piston and the inner diameter of the body member. The piston 18 is generally hollow and has a low pressure chamber 28 formed therein. The low pressure chamber 28 is provided with engine fluid, preferably oil, under normal engine oil pressure through mating inlet openings 30*a* in the body member 12 and 30*b* in the piston 18. The opening 30*a* or other openings also serve to lubricate the interface between the body member 12 and the piston 18 above an o-ring seal 50.

The low pressure chamber 28 has a valve opening 32 preferably formed through its bottom surface 34. The valve opening 32 allows engine fluid from the low pressure chamber 28 to flow to a high pressure chamber 36. The high pressure chamber 36 is defined by the area between the bottom surface 34 of the piston 18, the bottom bore surface 16, and the inner diameter 26 of the lash adjuster body 12.

The valve opening 32 is in communication with a check valve 38 which is normally biased into a closed position blocking the flow of engine fluid from the low pressure chamber 28 to the high pressure chamber 36. The check valve 38 preferably comprises a spherical metal ball 40 held in place by a first coil spring 42. The first coil spring 42 is in turn held in place by a bracket 44 pressed against the bottom surface 34 of the piston 18 by a second and larger coil spring 46. The second coil spring 46 biases the piston 18 upward in the absence of an opposing force. It should be understood that any other valve arrangement that allows for the selective engagement of the valve arrangement with the valve opening 32 may instead be employed.

As shown in FIG. 1, the engine fluid flows from the low pressure chamber 28 through the check valve 38 to the high pressure chamber 36. As the engine fluid fills up the high pressure chamber 36, the piston 18 travels upwardly until the piston 18 takes up any gap between the base circle of the cam 20 and the cam follower 22. As the cam 20 begins to raise another adjacent valve (not shown) against an opposing spring force, a force is applied to the piston 18 attempting to compress it downward. This increases the pressure in the high pressure chamber and closes the check valve 38, trapping the fluid therein. The downward force on the piston 18 is immediately opposed by the hydraulic pressure created in the high pressure chamber 36. This is unlike conventional lash adjusters having the oil leakage path running between the piston 18 and the body member 12 in parallel with the check valve. As a result, current lash adjusters collapse slightly during the lifting cycle.

As discussed above, the outer diameter 24 of the piston 18 and the inner diameter 26 of the plug body 12 are sized so that the piston 18 and the plug body 12 are in sliding arrangement. An O-ring 50 is positioned between the piston 18 and plug body 12 to seal off the high pressure chamber 36. A leak hole 52 is also formed through the bottom surface 34 of the piston 18. The leak hole 52 is formed in parallel with the check valve opening 32, but is smaller in diameter. The leak hole 52 is preferably located off-axis while the valve opening 32 is preferably formed in the center of the bottom surface 34 of the piston 18.

The leak hole 52 is in fluid communication with the high pressure chamber 36, and is normally blocked by a washer 54 located beneath the bottom surface 34 of the piston 18. The washer 54 is also held in place at its periphery by the bracket 44 and has an opening 56 formed through its center. The opening 56 is sufficiently large so as not to interfere with the action of the check valve 38. The washer 54 is preferably curved in the arc of a cylinder so that it does not completely block the leak hole 52.

When the primary cam follower 22 is on the base circle of the cam 20, and there is no (or a relatively small) difference in pressure between the low pressure chamber 28 and the high pressure chamber 36, the leak hole 52 provides a rapid leak-down rate. Similarly, as the cam 20 begins to lift an adjacent valve against an opposing spring force, the check valve 38 closes, permitting the pressure in the high pressure chamber 36 to rise. At some point shortly into the cycle, as a result of the opposing spring force, the difference in pressures between the low pressure chamber 28 and the high pressure chamber 36 becomes high enough to collapse the washer 54, sealing off the leak hole 52 and preventing further leak-down for the duration of the valve open/close cycle.

The stiffness and geometry of the curved washer 54 determine the pressure differential necessary to collapse it. While not critical, the collapse pressure should be set sufficiently high so that there is no danger of the adjuster "locking up" because of small forces between the cam 20 and the cam follower 22. It will be obvious to one of ordinary skill in the art that the lower the pressure required to collapse the washer 54, the earlier into the cycle the leak back is stopped. The amount of oil that leaks back in the interval after the valve starts to lift and before the washer collapses will depend somewhat on oil viscosity. However, unlike with conventional lash adjusters, in the present invention, variation in oil viscosity affects only the small amount of oil that leaks back before the washer collapses. For example, if the washer is set to collapse at a pressure at which 5% of the fluid leaks back in the present invention as compared to the amount of fluid that would have leaked back with a conventional lash adjuster, the effect of oil viscosity on leakback is reduced twenty-fold.

The washer 54 can be made out of any one of a number of resilient materials capable of undergoing repeated small flexures and also capable of withstanding the ambient temperatures involved, a preferred material being a spring steel.

Since the washer 54 has a cylindrical curvature, it is not circularly symmetric, and should be prevented from rotating so that the impedance of the leak path through the leak hole 52 does not change. This can be accomplished by using a locating key (not shown) to insure that the washer 54 does not rotate. Alternatively, several leak holes could be drilled in a 180° sector of the piston 18 so that rotation of the washer 54 would not change the leak path impedance.

FIGS. 2 and 3 illustrate alternative embodiments of a lash adjuster mechanism in accordance with the present invention. Structures in these embodiments that are the same as in the previous embodiment will be given the same reference numbers as before for convenience. As shown in FIG. 2, the leak hole 52 is eliminated. The spherical metal ball 40 of the check valve 38 seats directly on the curved washer 54. When the cam begins to open an adjacent valve, the first action is for the metal ball 40 to seat on the curved washer 54 closing the washer opening 56. The outer edge of the washer is "D"-shaped with the straight portion being perpendicular to the axis of curvature. Thus, as long as the washer has not collapsed against the bottom surface 34 of the piston 18, there will still exist a leakage path between the valve opening 32 and the high pressure chamber 36. As the pressure rises, the washer 54 flattens, eliminating all leakage.

In FIG. 3, the check valve 38 is eliminated entirely and a "D"-shaped curved disk 60 is substituted for the curved washer. Below a threshold pressure differential, the curved disk 60 allows fluid flow though the valve opening 32 and past the disk 60 into the high pressure chamber 36. When the pressure is above the threshold pressure, the curved disk 60 collapses blocking the valve opening 32.

The embodiment of FIG. 3 is less expensive than other embodiments discussed above because of the elimination of several components, such as a ball, spring coil, and bracket. Because fluid flow through the valve opening 32 is slightly more restricted in this embodiment, the "pump-up" times may be slightly longer then with the previous embodiments. However, by placing holes in the disk 60 outside the sealing region or by other design changes, this effect can be minimized.

Alternatively, another form of the invention may be utilized with what is commonly referred to as a "bucket" tappet. In this configuration, the cam follower is eliminated and the lash adjuster is positioned directly between the cam and the valve being actuated.

The present invention may be embodied in other specific forms without departing from the spirit or essential attributes thereof; therefore, the illustrated embodiments should be considered in all respects as illustrative and not restrictive, reference being made to the appended claims rather than to the foregoing description to indicate the scope of the invention.

What is claimed is:

1. A system for minimizing the amount of lash in valve components of an internal combustion engine comprising:

a hydraulic lash adjuster mechanism comprising:

a body having a bore formed therein;

a piston slidingly received within said bore, said piston having a top surface and a bottom surface;

a low pressure chamber formed in said piston;

a high pressure chamber formed between a bottom of said bore and said bottom surface of said piston;

an inlet opening for supplying fluid to said low pressure chamber;

a valve opening in said piston providing fluid communication between said low pressure chamber and said high pressure chamber;

a moveable mechanism for selectively opening or closing said valve opening in response to pressure differences between said low pressure chamber and said high pressure chamber; and a leak down control member comprising a curved washer located adjacent the bottom surface of said piston with said washer being movable between a first position preventing leak down of engine fluid and a second position allowing leak down of engine fluid from said high pressure chamber to said low pressure chamber;

a cam follower in communication at one end with said top surface of said piston and with a valve stem at the other end; and a cam for applying force to said piston during a valve lift event.

2. The system of claim 1, wherein said lash adjuster mechanism further comprises:

a leak hole formed in said bottom surface of said piston for allowing leak down of engine fluid from said high pressure chamber during non-valve lift event conditions.

3. The system of claim 1, wherein said moveable mechanism is a check valve seated in said valve opening.

4. The system of claim 1, wherein said movable mechanism is a check valve seated in said valve opening and wherein said lash adjuster mechanism further comprises:

a leak hole formed in said bottom surface of said piston for allowing leak down of engine fluid from said high pressure chamber during non-valve lift conditions.

5. The system of claim 4, wherein said curved washer is movable between a position sealing off said leak hole and a position allowing leak down of engine fluid through said leak hole, whereby when the difference between the pressures in said low and high pressure chambers is below a predetermined value, said curved washer allows leak down not engine fluid through said leak hole.

6. The system of claim 5, wherein said engine fluid leaks down to said low pressure chamber through an opening formed in said curved washer.

7. The system of claim 5, wherein when said cam begins to lift the valve, said check valve closes and thereafter as the pressure difference between said low and high pressure chambers reaches said predetermined value, said curved washer seals off said leak hole.

8. The system of claim 2, wherein said leak down control mechanism is moveable between a position sealing off said leak hole and a position allowing free leak down of engine fluid, whereby when the pressure difference between said low and high pressure chambers is less than a predetermined value, said curved washer having a central opening, allows leak down of engine fluid through said opening.

9. The system of claim 1, wherein said movable mechanism is a check valve that engages an opening formed in said leak down control member to prevent fluid flow from said low pressure chamber to said high pressure chamber.

10. The system of claim 9, wherein said curved washer has a central opening which engages said check valve.

11. The system of claim 3, wherein said check valve further includes a spherical member supported by a spring member and biased into a normally closed position, and a bracket attached to said bottom surface of said piston for supporting said spring member.

12. A hydraulic lash adjuster mechanism for an internal combustion engine that operates in response to movement of a cam and a force applied thereto by a cam follower, said lash adjuster mechanism comprising:

a body having a bore formed therein with a general circular inner periphery and a bore bottom;

a reciprocating piston received within said hollow body and having a top surface and a bottom surface;

a low pressure chamber formed in said piston and in communication with an engine fluid supply;

a high pressure chamber defined in said hollow body by said body inner periphery, said bottom surface of said piston, and said bore bottom;

a valve opening formed in said bottom surface of said piston allowing engine fluid to flow from said low pressure chamber to said high pressure chamber;

a valve mechanism for selectively opening or closing said valve opening in response to pressure differences between said low pressure chamber and said high pressure chamber; and a leak down control member comprising a curved washer located adjacent the bottom surface of said piston with said washer being movable between a first position preventing leak down of engine fluid and a second position allowing free leak down of engine fluid from said high pressure chamber to said low pressure chamber when said cam follower is on the cam base circle.

13. The hydraulic lash adjuster mechanism of claim 12, further comprising:

a leak hole formed through said bottom surface of said piston allowing free leak down of engine fluid from said high pressure chamber during non-valve-lift conditions.

14. The hydraulic lash adjuster mechanism of claim 13, wherein said valve mechanism is a check valve seated in said valve opening.

15. The hydraulic lash adjuster mechanism of claim 13, said washer being movable between a position sealing off said leak hole and a position allowing free leak down of engine fluid, whereby when there is little difference between the pressure in the low and high pressure chambers said curved washer allows free leak down of engine fluid through said leak hole.

16. The hydraulic lash adjuster mechanism of claim 15, wherein as the cam begins to lift the valve, said check valve closes and thereafter as the pressure difference between said low and high pressure chambers reaches a predetermined level, said washer seals off said leak hole.

* * * * *